United States Patent [19]

Callander

[11] Patent Number: 5,028,160

[45] Date of Patent: Jul. 2, 1991

[54] PAPER HANDLING DEVICE

[76] Inventor: Bruce H. Callander, 29 Kronquist Ct., San Francisco, Calif. 94131

[21] Appl. No.: 430,567

[22] Filed: Oct. 30, 1989

[51] Int. Cl.[5] ..... B42F 13/42

[52] U.S. Cl. ..... 402/7; 402/15; 402/80 R

[58] Field of Search ..... 402/80 R, 7, 15, 13, 402/68, 8, 60, 47

[56] References Cited

U.S. PATENT DOCUMENTS

| | | | |
|---|---|---|---|
| 1,874,031 | 8/1932 | Dawson | 402/47 |
| 2,836,182 | 5/1958 | Gramacy | 402/47 |
| 4,084,911 | 4/1978 | De Witt | 402/15 |
| 4,300,848 | 11/1981 | Waegemann | 402/13 |
| 4,427,315 | 1/1984 | Raisch | 402/7 |
| 4,632,586 | 12/1986 | Erickson | 402/80 R |
| 4,869,613 | 9/1989 | Corey | 402/7 |

FOREIGN PATENT DOCUMENTS

| | | | |
|---|---|---|---|
| 930987 | 7/1955 | Fed. Rep. of Germany | 402/80 R |
| 1115384 | 4/1956 | France | 402/80 R |

*Primary Examiner*—Paul A. Bell

*Attorney, Agent, or Firm*—Flehr, Hohbach, Test, Albritton & Herbert

[57] ABSTRACT

A paper handling device for use with sheets of paper fastened together in a stack by two fastening posts to enable transfer of the sheets from the posts to the handling device. The paper handling device preferably has a U-shaped body with two finger portions that extend outwardly from a manually grippable handle portion. The finger portions have extensions or ends with a length dimensioned to extend along a substantial distance of the posts and a thickness dimension enabling positioning of the finger ends next to the posts for sliding of the paper over a combination of the posts and the finger ends. A structure for alignment of the posts with the fingers is provided.

15 Claims, 3 Drawing Sheets

PAPER HANDLING DEVICE

TECHNICAL FIELD

The present invention relates, in general, to paper fastening systems which employ paper fasteners with bendable ribbon-like posts or tabs that secure a stack of pre-punched papers together in a file folder or the like, and more particularly, relates to apparatus for handling and transferring such stacks of paper without loosing the alignment of the punched holes.

BACKGROUND ART

Loose sheets of paper commonly are bound together by punching holes proximate one of the sides of the sheets and then binding the sheets together, often in a folder or file, by means of a U-shaped paper fastener. Such fasteners typically are constructed of a thin metal strip having a cross body and a pair of ribbon-like, bendable, posts or tabs which extend up through aligned or registered holes to enable the stack of sheets to be fastened into the file or folder. Such fastener systems are manufactured, for example, by Acco International, Inc. of Wheeling, Ill. and sold under the trademark ACCO Fasteners. U-shaped paper fasteners are often mounted to files by punching holes in the file, but they also can be pre-mounted in the file. Perhaps the most common form is the two-hole fastener formed of tin-plated or enamel-coated steel.

While bendable ribbon-like file fastening systems have been found to be highly desirable for binding stacks of paper together, there are certain problems which commonly are encountered in connection with using such fastening systems It is often necessary, for example, for the user to be able to have access to a sheet or sheets which are in the middle or at the bottom of the stack of bound papers. A common reason for such mid-file access is the need to photocopy papers from the file. When the sheets above the sheet to be accessed are removed from the U-shaped file fastener, it is very difficult to maintain the vertical registration or alignment of the punched holes in the paper sheets. Thus, when the copying is done and the file is to be reassembled, a tedious process of realignment or sheet-by-sheet remounting of the paper sheets onto the fastener posts must be undertaken. As the number of sheets increases, the problem of maintaining the alignment of punched holes and/or remounting the sheets to the fasteners increases.

Attempts to lessen or overcome the problem of maintaining alignment of punched sheets of paper when they are removed from the file and paper fastener have largely been based upon redesigning the entire paper fastening system. Thus, U.S. Pat. No. 4,300,848 to Waegemann, for example, discloses a paper fastener system in which very specialized posts are provided with relatively complex attachment structures on the ends of the posts. These structures mate with complimentary ends of a temporary paper storage attachment so that file papers can be slidably transferred from the fastening posts to the paper storage device. The Waegemann paper fastening and transferring system, however, is not suitable for use with conventional paper fasteners which do not have the necessary interlocking end structures. Thus, there is a vast supply of existing files for which the specialized Waegemann temporary storage device could only be used by replacement of the existing paper fasteners with the fastening posts of the type shown in Waegemann.

There are other posts-based binder systems in which male and female posts are carried by separable halves of a binder. Typical of these systems are the binders disclosed in U.S. Pat. No. 1,874,031 to Dawson and U.S. Pat. No. 2,836,182 to Gramacy. It is possible to separate the binder halves with a portion of the stack of papers retained in alignment by the telescoping posts in one half of the binder and the remainder of the stack maintained in alignment by the posts in the other half of the binder. This system requires relatively expensive and specialized telescoping posts and binders. It is not suitable for use with conventional bendable file fasteners. Additionally, use of telescoping binder posts requires that the stack portions be manipulated while mounted to the respective binder halves, which is sometimes relatively awkward.

Accordingly, it is an object of the present invention to provide an apparatus for handling paper which can be used in conjunction with conventional, bendable, ribbon-like, paper fastening systems.

Another object of the present invention is to provide a paper handling apparatus which allows easy separation of sheets of paper from the interior of a stack of sheets, without disturbing or losing the alignment of the sheets removed from the fastened stack.

Another object of the present invention is to provide a paper handling apparatus which facilitates the remounting of separated sheets of the stack back onto the paper fastening posts for rebinding of the stack.

It is a further object of the present invention to provide a paper handling apparatus which is durable, compact, easy to maintain, has a minimum number of components, is easy to use by unskilled personnel, and is economical to manufacture.

The apparatus of the present invention has other objects and features of advantage which will be more readily apparent from the following description of the Best Mode Of Carrying Out The Invention and the appended claims, when taken in conjunction with the accompanying drawing.

DISCLOSURE OF INVENTION

The paper handling device of the present invention is designed for use with sheets of paper which are fastened together in a stack by at least two fastening posts to enable transfer of the sheets from the fastening posts to the handling device. Each of the sheets has at least two holes therein and the sheets are slidably mounted on the fastening posts. The paper handling device of the present invention is comprised, briefly, of a manually grippable handle portion and at least two finger portions extending outwardly of the handle portion in generally parallel relation. The finger portions are spaced apart by a distance substantially equal to the distance between the holes in the sheets of paper, and the finger portions have ends of sufficient length for positioning in side-by-side relation to a substantial length of the posts. Additionally, the ends of the finger portions have a thickness dimension for sliding movement of the sheets of paper along the combination of the posts and ends while in side-by-side relation until the sheets of paper have been moved off the fastening posts and onto the finger portions. Most preferably, the paper handling device includes alignment means, such as slots, which receive the ends of ribbon-like fastening posts and temporarily secure the posts in side-by-side abutting relation to the ends of the fingers.

BEST MODE OF CARRYING OUT THE INVENTION

Figure 1:
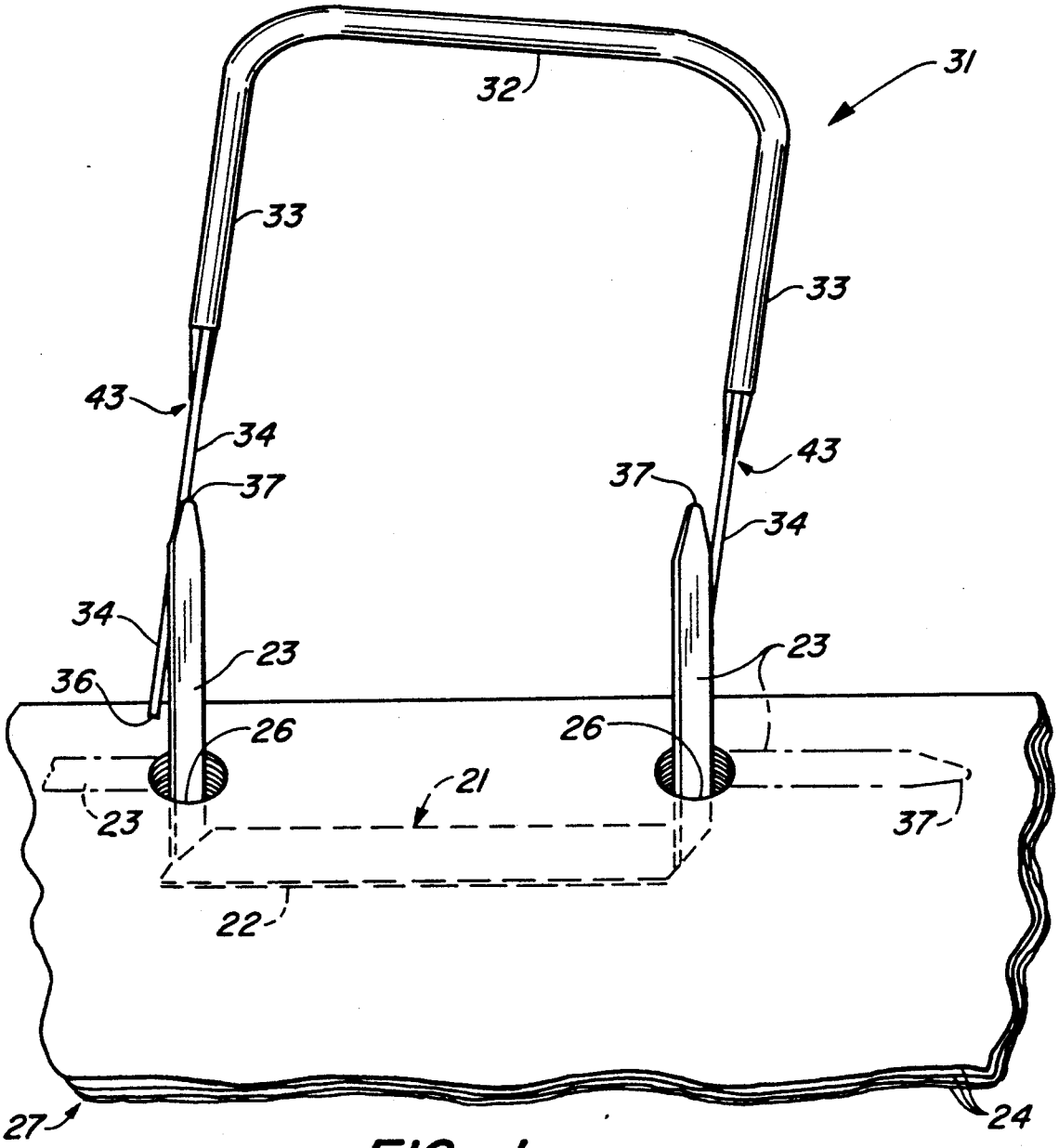
FIG. 1 is a top perspective view showing a paper handling device constructed in accordance with the present invention and used in conjunction with a common ribbon-like paper fastener.

The paper handling device of the present invention is designed for use with standard or conventional bendable post-type paper fasteners, such as are in widespread use with file folders. As best may be seen in FIG. 1, a U-shaped paper fastener, generally designated 21, typically will have a cross-body portion 22 from which bendable ribbon-like posts 23 extend. Slidably mounted over posts 23 are a plurality of sheets of paper 24, which are each prepunched with holes 26 spaced to receive fastening posts 23. Usually fastener 21 is used to fasten stack 27 of sheets 24 into a file folder 28 (FIGURE 2). Once the sheets have been slid down to the position shown in FIG. 1, the bendable post may be bent to the outward position shown in phantom in FIG. 1 or a binding assembly (not shown) can be mounted onto posts 23 and the posts bent inwardly and secured by slides on the binding assembly. Fastener 21 can be provided independently of the file folder or mounted permanently in the file folder by the manufacturer of the file folder. This bendable post paper fastening system is extensively used in business, and there are literally millions, and perhaps billions, of files which employ this type of paper fastener.

While the typical paper fastening system in connection with which the paper handling device of the present invention is used would include a two-post fastener connected by cross member 22, it will be understood that the paper handling device of the present invention can also be used with paper fastener systems having more than two posts. The paper handling device of the present invention, generally designated 31, maintains alignment of at least a pair of holes 26 in the paper sheets, which will result in maintenance of the alignment of any additional holes for additional fastening posts.

The widespread use of bendable paper fastening systems, such as described above, has resulted in certain standard diameters of and spacing between the paper holes. Thus, virtually every office which does filing using paper fasteners such as fastener 21 also will have two-hole punches which will punch holes 26 at precisely the correct spacing and with the proper hole diameter to slidably receive ribbon-like posts 23. Holes 26, therefore, are conventionally spaced at centers of about 2.75 inches, and the hole diameter typically will be about 0.250 inches. Post 23 usually has a width dimension of about 0.195 inches and a thickness dimension of about 0.010 inches. The relative size of the holes 26 to the posts 23 can be best seen in FIG. 2A. The clearance between the edges of post 23 and hole 26, therefore, is about 0.0275 inches on each side of the post. This enables the posts to be readily inserted through holes 26, if the holes are all precisely aligned. As the papers become misaligned, however, the problem of insertion of the posts through the holes increases, and at some point the papers must be individually mounted on the posts.

Virtually everyone who has used conventional file folders has encountered the situation in which a paper in the middle or at the bottom of the file must be accessed, for example, to enable photocopying. Virtually everyone who has used such file folders has also experienced the problem of the papers in the removed stack of paper shifting during photocopying of the desired document. The result is that the removed stack of papers, which were on top of the accessed document, must be tediously remounted on a paper-by-paper basis onto fastener post 23. In a worst case scenario, which occurs not infrequently, the stack of removed papers shifts or falls so that not only the alignment of the holes is lost, but the order in which the papers are filed also is lost. The likelihood of this occurring increases with the number of papers in the stack which is removed from the file, and the difficulty resulting from such shifting and disruption of the stack also increases with the number of papers in the file.

Paper handling apparatus 31 of the present invention is formed to enable transfer of stacks of paper from conventional file fasteners while maintaining the transferred or removed stack in registration. The removed papers can be temporarily stored on the paper handling device, and then the device can be used to rapidly remount the removed stack back onto the file fastener.

Figure 2:
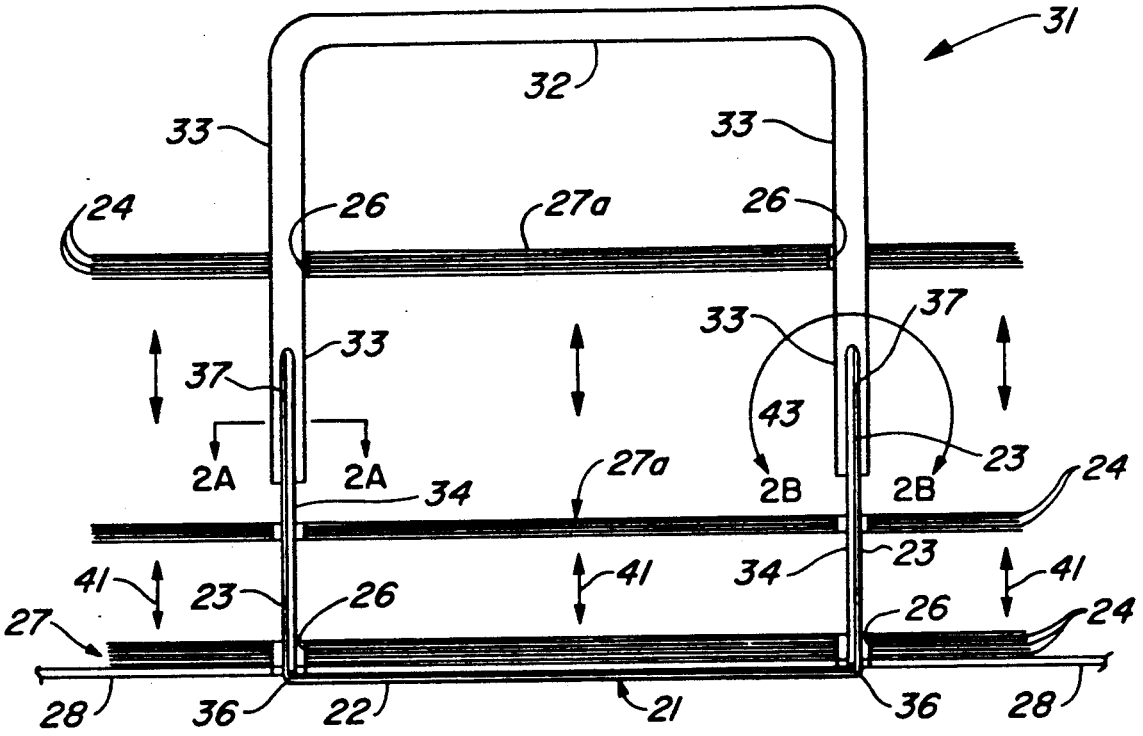
FIG. 2 is a side elevation view, in slightly reduced scale, of the paper handling apparatus of FIG. 1 showing sheets of paper being transferred to the apparatus.

As best may be seen in FIGS. 1 and 2, paper handling device 31 includes a manually grippable handle portion 32 from which at least two finger portions 33 extend. Finger portions 33 can be seen from FIG. 2 to extend from handle 32 in generally parallel relation, and fingers 33 are spaced apart by a distance which is substantially equal to the distance between holes 26 in sheets 24 of paper. In the conventional paper fastening system used in business files, the spacing of finger portions 33 is on about 2.75 inch centers.

In order to permit use with conventional fasteners 21, paper handling device 31 is formed with finger portions 33 which have extension portions or ends 34 of sufficient length for positioning in side-by-side relation to a substantial length of each of posts 23. As will be seen in FIG. 2, for example, extensions or ends 34 of finger portions 33 preferably, although not necessarily, extend over the entire length of bendable posts 23. As will be seen in FIG. 2, therefore, the lower or terminal ends 36 of extensions 34 is inserted into openings 26 until it rests on the file folder 28. The upper ends 37 of bendable fastener posts 23 terminate just short of the position at which extensions or ends 34 extend from the base of finger portions 33, as best may be seen in FIG. 2B. As will be appreciated, there are several conventional post lengths which are in use in business today, and for the longer lengths, terminal ends 26 of the fingers may not reach file folder 28.

Figure 2A:
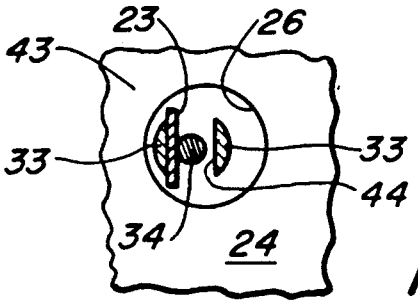
FIG. 2A is an enlarged, fragmentary, cross-sectional view taken substantially along the plane of line 2A—2A in FIG. 2.

In order to permit smooth and undisrupted transfer of papers from fastener 21 to paper handling device 31, extensions or ends 34 of the finger portions of the paper handling device also have a thickness dimension for sliding movement of sheets 24 of paper along a combination of posts 23 and ends 34. For conventional prepunched holes a conventional ACCO brand fastener, end 34 preferably have a diameter in a range of about 0.100 to about 0.030 inches and most preferably in the range of about 0.050 to about 0.040 inches. As best may be seen in FIGS. 2 and 2A, rod-like ends 34 of the paper handling device of the present invention having such a diameter may be easily inserted in openings 26 and positioned in side-by-side abutting relation with ribbon-like fastener posts 23. Once so positioned, a partial stack 27*a* of papers may be slidably moved along the side-by-side posts and ends with substantial clearance between holes 26 and the combination of the posts 23 and ends 34. Stack 27*a* can be moved upwardly until it passes over upper ends 37 of fastening posts 23. At this point, stack portion 27*a* will slide onto the somewhat thicker or larger diameter base or body of finger portions 33. As seen in FIG. 2A, it is preferable that the base of finger portion 33 is smaller in diameter than holes 26.

Figure 6:
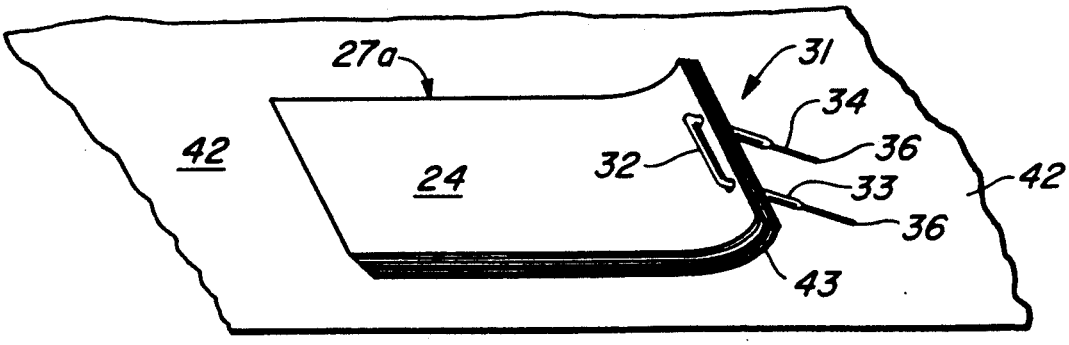
FIG. 6 is a top perspective view, in reduced scale, of a stack of papers transferred to the paper handling device of the present invention.

Once partial stack 27*a* is in the upper position of FIG. 2, the stack of papers and paper handling apparatus can be lifted up from the folder and fastener 21 for manipulation of partial stack 27*a* apart from the file folder and fastener 21. As best may be seen in FIG. 6, one of the convenient uses of paper handling device 31 is as a temporary storage device. Ends 36 of the paper handling device can be placed on a support surface 42 which will tilt or bend one end 43 of stack 27*a* upwardly and apply a slight downward reaction force on the paper handling device. This reaction force traps the stack against falling off the paper handling device and assures that stack 27*a* will hold together as a unit apart from the file.

Figure 2B:
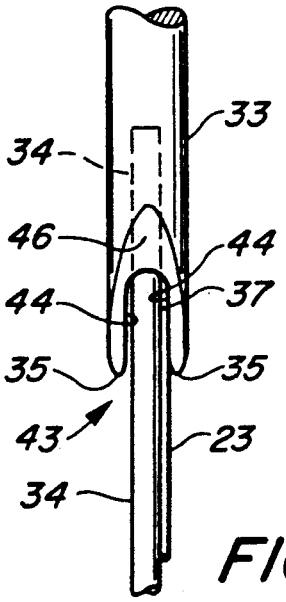
FIG. 2B is a fragmentary, side elevation view of the area bounded by line 2B—2B in FIG. 2.

In the preferred form, paper handling device 31 includes alignment means, generally designated 43, mounted to one of handle portion 32 and finger portions 33. In the most preferred form of the present invention, alignment means 43 is provided by slots 44 (FIG. 2B) on either side of rod ends 34, which slots extend into the base. Slots 44 are dimensioned for sliding receipt of the upper ends 37 of the bendable posts between the rod members 34 and the body 33 of the fingers. When a slot is provided on either side of finger end 34, device 31 can be inserted into the openings 26 on either side of the bendable posts. As shown in FIG. 2, the ends 36 of the fingers have been inserted on the insides of the respective posts 23. They also can be inserted on the outside of one finger and inside of the other, or on the outside of both fingers. In each of these combinations, upper ends 37 are slid between rod ends 34 and finger body 33, as shown in FIG. 2A. Ends 35 of finger body 33 are advantageously tapered outwardly as shown in FIG. 2B to facilitate insertion of post ends 37 into slots 44. Also the inward taper on the outer side of ends 35 facilitates passage of the paper stack up onto the body 33 of the paper handling apparatus.

With the upper ends of posts 23 trapped in the alignment slots and the lower ends 36 of the fingers preferably positioned in holes 26 in stack 27 of papers. The papers, in effect, are trapped or captured on the combination of the finger ends and posts and can be slidably transferred to a position above the ends of the fastening posts for removal of the partial stack of papers on paper handling device 31.

Figure 2C:
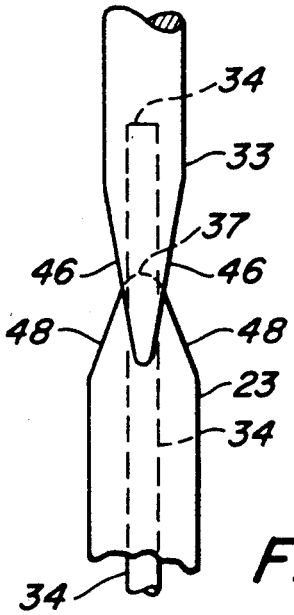
FIG. 2C is a fragmentary, end elevation view of the portion of the apparatus shown in FIG. 2B.
Figure 8:
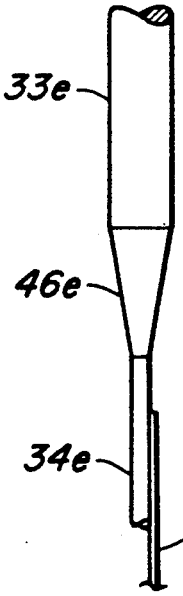
FIG. 8 is a fragmentary, enlarged, side elevation view of another alternative embodiment of the finger portion of the paper handling device of the present invention.

The smooth and uninterrupted transfer of sheets 24 from fastener 21 to paper handling device 31 of the present invention, is facilitated by providing tapered surfaces 46 (FIG. 2C) or a conical surface 46*e* (FIG. 8) and tapered ends 35 (FIG. 2B) between the finger bases and extensions or ends 34. As best may be seen in FIG. 2C, therefore, tapered surfaces 46 taper from a diameter less than that of rod members 34 to the final base diameter of finger base 33. As also may be seen in FIG. 2C, the standard bendable fastener post 23 typically has a tapered edge 48 at the ends thereof so that the transition back to the posts from the paper handling device is also a smooth transition.

It should be noted, that alignment means 43 is not an absolute requirement for use of the paper handling device of the present invention. In the form of the invention shown in FIG. 8, for example, finger base 33*e* has a conical surface 46*e* which tapers to the small diameter ends 34*e*. Posts 23*e* may be held easily against ends 34*e* by the users fingers when transferring the papers back onto posts 23*e*.

It is relatively simple to bend fastening posts 23 to a substantially vertical and parallel alignment. The ends 34 of the fingers can be inserted into the holes in the paper next to the fastening posts. Raising of partial stack 27*a*, as indicated by arrows 41 in FIG. 2, will cause the fastening post to be displaced into substantially abutting relation with ends 34 of fingers 33. The transfer of stack 27*a* back onto the fastening post, however, is greatly facilitated by alignment means 43, but one can also accomplish this transfer back by simply pressing upper ends 37 of posts 23 out against finger ends 34 during the transfer back to the fastening posts.

FIGS. 3, 4, 5 and 7 illustrate further alternative embodiments of the finger portions of the paper handling device constructed in accordance with the present invention. In each of these embodiments, a different form of alignment means is provided for aligning the bendable posts with the finger portions.

Figure 3A:
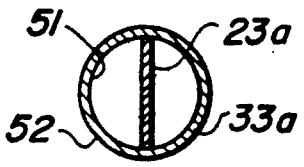
FIG. 3A is an enlarged, cross section view, taken substantially along the plane of line 3A—3A in FIG. 3.
Figure 3:
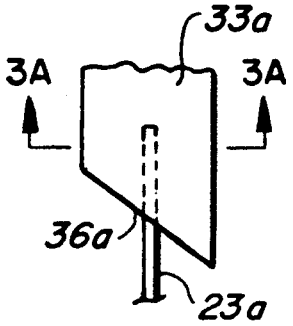
FIG. 3 is a fragmentary, side elevation view of an alternative embodiment of the paper handling device of the present invention.

In the embodiment shown in FIGS. 3 and 3A, fingers 33*a* are provided as tubular members having an interior diameter 51 dimensioned for sliding receipt of post 23*a*. External diameter 52 of finger ends 33*a* is dimensioned for sliding movement with respect to punched holes 26 in the paper. A tube having an internal diameter 51 of 0.205 inches and a wall thickness of 0.010 inches will have sufficient clearance both internally and externally to allow the tabs 23 to be inserted into the open end of the tube and the tube inserted into holes 26. As best may be seen in FIG. 3, it is also preferable that the transition surface 36*a* of the finger base be tapered to facilitate insertion of the fingers into holes 26.

Figure 4A:
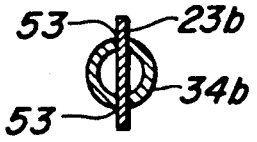
FIG. 4A is an enlarged, cross section view, taken substantially along the plane of line 4A—4A in FIG. 4.
Figure 4:
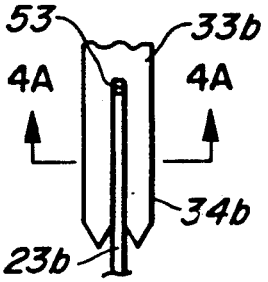
FIG. 4 is a fragmentary, side elevation view of a further alternative embodiment of the finger portion of the paper handling device of the present invention.

In the form of the invention shown in FIGS. 4 and 4A, tubular fingers 33*b* have ends 34*b* which are formed with a pair of aligned slots 53 dimensioned for sliding receipt of post 23*b*. The external diameter of fingers 34*b* is substantially less than the width dimension of post 23*b*, and the post can be seen in FIG. 4A to extend outwardly of the fingers. Thus in the alignment means shown in FIGS. 4 and 4A the post is slidably received in slots 53 and is at least partially inside the tubular ends and partially outside the ends. The pre-punched holes in the paper are still able to slide smoothly along the posts and then onto fingers 33*b*.

Figure 5A:
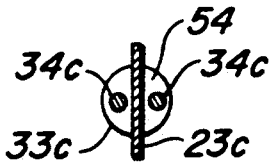
FIG. 5A is a cross section view taken substantially along the plane of line 5A—5A in FIG. 5.
Figure 5:
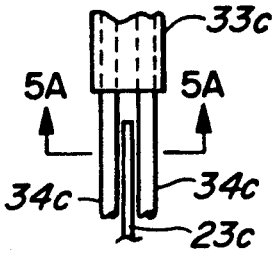
FIG. 5 is a fragmentary, enlarged, side elevation view of further alternative embodiment of the finger portion of the paper handling device of the present invention.

In the form of the invention shown in FIGS. 5 and 5A, a pair of rod members 34*c* extend outwardly of finger base 33*c* and receive the post 23*c* therebetween. FIG. 5A illustrates how the pair of rod ends 34*c* provides an alignment slot 54 which slidably receives the bendable posts.

Figure 7A:
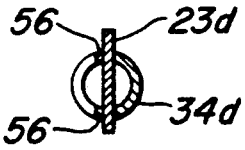
FIG. 7A is a cross section view taken substantially along the plane of line 7A—7A in FIG. 7.
Figure 7:
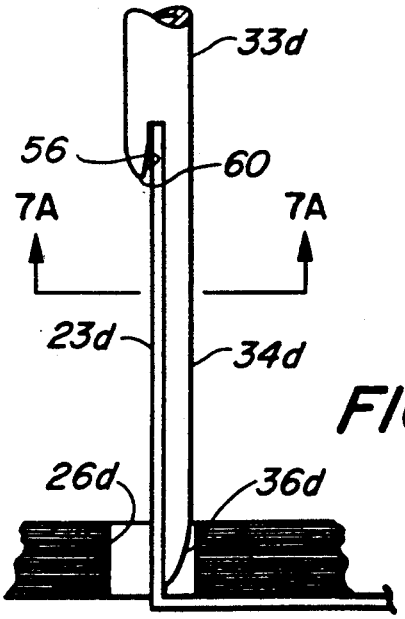
FIG. 7 is a fragmentary, enlarged, side elevation view of a further alternative embodiment of the finger portion of the paper handling device of the present invention.

Still a further alternative embodiment of the present invention is shown in FIGS. 7 and 7A. As will be seen, fingers 33*d* are again tubular and have a slot 56 in the ends dimensioned to receive the upper end of post 23*d*. Again, it is advantageous if surface 60 at the entry of slot 56 is tapered outwardly or sloped to facilitate entry of the post end into the slot. In the version shown in FIG. 7, however, only one side or leg 34*d* of the tubular finger extends down post 23*d* a distance sufficient for insertion into holes 26*d*. Most preferably, end 36*d* is tapered to facilitate such insertion.

The paper handling device of the present invention has been described by reference to the conventional or standard form of bendable paper fastening system. It will be understood, however, that the handling device of the present invention can be readily modified to accommodate other shapes of paper fastening posts without departing from the spirit or scope of the present invention. Paper handling apparatus 31 may be formed with a one-piece U-shaped handle and fingers into which rod members or extensions of reduced diameter 34 are mounted. Handle portion 32 can also be formed of a larger diameter than finger 33 and can include finger indentations or gripping surfaces (not shown) which facilitate manipulation of the device. The apparatus can be formed of metal, plastic, fiberglass, wood or other conventional building materials. The relatively simple structure of the paper handling device of the present invention enable it to be fabricated at modest cost, and the simplicity of the device enables its use by unskilled personnel with little or no training.

What is claimed is:

1. In a paper handling device for use with sheets of paper having a pair of holes therein fastened together in a stack by a U-shaped fastener having two bendable, ribbon-like, fastening posts extending through said holes, said handling device including a manually grippable handle portion, and at least two finger portions extending transversely of said handle portion in generally parallel relation to each other and spaced apart by a distance substantially equal to the distance between said holes, the improvement in said paper handling device comprising:

said finger portions having finger ends with at least one of said finger ends being provided by a pair of rod members mounted in side-by-side spaced apart relation to define a post-receiving slot therebetween.

2. A paper handling device for use with sheets of paper having a pair of holes therein, said sheets of paper being fastened together in a stack by at least two bendable, ribbon-like fastening posts each having a pair of opposed flat sides with connecting relatively short edges extending through said holes and terminating in distal post ends, said handling device comprising:

a manually grippable handle portion; and at least two finger portions extending transversely of said handle portion in generally parallel relation to each other and spaced apart by a distance substantially equal to the distance between said holes, said finger portions each having fastening post alignment means provided thereon and formed for slidable receipt and alignment of said distal post ends with said finger portions, said finger portions further having finger ends extending a substantial distance beyond said alignment means in a direction away from said handle portion, said finger ends being formed for positioning in contact with said posts by movement of said finger ends in a direction transverse to a longitudinal axis of said finger ends to position a side of each of said finger ends next to a flat side of each of said posts over a substantial length of each of said posts, said finger ends further being formed to guide said distal post ends into engagement with said alignment means, and said finger ends having a thickness dimension sufficiently small for sliding movement of said sheets of paper along a combination of said posts and said finger ends, when said finger ends are positioned next to said posts, until said sheets are moved to a position beyond said posts.

3. A paper handling device as defined in claim 2 wherein, said alignment means is provided as slots in each of said finger portions defined in part by a wall coplanar with a side of said finger ends, said slot being dimensioned to slidably receive distal post ends.

4. A paper handling device as defined in claim 3 wherein, said finger portions taper outwardly on a side opposite the coplanar wall at an entry to said slots to facilitate entry of said distal post ends into said slots.

5. A paper handling apparatus as defined in claim 4 wherein, said slots are provided as a pair of slots on each of said finger portions on opposite sides of each of said finger ends.

6. A paper handling device as defined in claim 3 wherein, said finger ends each extend from finger portions having finger bases formed with a thickness dimension greater than said finger ends, said finger bases further having a thickness dimension less than the diameter of said holes.

7. A paper handling device as defined in claim 6 wherein, said slots are formed in each of said finger bases in a position proximate and along side the position at which said finger ends extend from said finger bases.

8. A paper handling device as defined in claim 7 wherein, said finger bases taper inwardly to said finger ends, and said finger ends are each provided by rod-like members.

9. In a paper handling device for use with sheets of paper having a pair of holes therein fastened together in a stack by a U-shaped fastener having a fastener base portion and two bendable, ribbon-like, fastening posts with opposed flat sides and connecting relatively short edges extending away from said base fastener portion and through said holes, said posts terminating in distal post ends, said handling device including a manually grippable handle portion, and at least two finger portions extending transversely of said handle portion in generally parallel relation to each other and spaced apart by a distance substantially equal to the distance between said holes, the improvement in said paper handling device comprising:

said finger portions each having post alignment means formed to engage and hold one of said distal ends in alignment with each of said finger portions, and said finger portions each having finger ends extending beyond said alignment means to a position proximate said fastener base portion, and said finger ends each having open sides beyond said alignment means for positioning of an open side of each of said finger ends in side-by-side relation to a substantial length of each of said flat sides of said posts, and said finger ends having a thickness dimension which is sufficiently small for sliding movement of said sheets of paper along a combination of said posts and said finger ends, while said posts and said finger ends are in side-by-side relation, until said sheets are moved to a position beyond said posts.

10. The paper handling apparatus as defined in claim 9 wherein, said finger ends are each provided as rod members having a diameter less than the opening between a side of said ribbon-like fastening posts and said holes.

11. The paper handling apparatus as defined in claim 10 wherein, said rod members have a diameter in the range of about 0.100 inches to about 0.030 inches.

12. The paper handling apparatus as defined in claim 11 wherein, said rod members are steel rods having a diameter between about 0.050 to about 0.040 inches.

13. The paper handling device as defined in claim 9 wherein, said finger ends each are semi-circular in cross section to provide at least one planar surface along a side of said finger ends for engagement with said flat sides of said posts and to provide a round opposite side on each finger end for sliding engagement with said paper defining said holes.

14. The paper handling device as defined in claim 13 wherein, said planar surface is provided on a side of each of said finger ends facing the other of said finger ends.

15. The paper handling device as defined in claim 13 wherein, said finger ends are provided by a semicircular tubular member with said planar surface being defined by spaced apart radially extending edges on said tubular member.

* * * * *